US009895618B1

(12) United States Patent
Huang

(10) Patent No.: US 9,895,618 B1
(45) Date of Patent: Feb. 20, 2018

(54) CHILDREN'S ENTERTAINMENT DEVICE WITH WATER SLIDE

(71) Applicant: BESTWAY INFLATABLES & MATERIAL CORP., Shanghai (CN)

(72) Inventor: Shuiyong Huang, Shanghai (CN)

(73) Assignee: Bestway Inflatables & Material Corp., Shanghai (CN)

( * ) Notice: Subject to any disclaimer, the term of this patent is extended or adjusted under 35 U.S.C. 154(b) by 0 days.

(21) Appl. No.: 15/390,233

(22) Filed: Dec. 23, 2016

(30) Foreign Application Priority Data

Oct. 8, 2016 (CN) ..... 2016 2 1105309 U

(51) Int. Cl.
*A63G 21/18* (2006.01)
*A63G 31/00* (2006.01)

(52) U.S. Cl.
CPC ..... *A63G 21/18* (2013.01); *A63G 31/007* (2013.01)

(58) Field of Classification Search
CPC ..... A63G 21/00; A63G 21/18; A63G 31/00; A63G 31/18
USPC ..... 472/116–117, 128, 134; 104/53, 69, 70
See application file for complete search history.

(56) References Cited

U.S. PATENT DOCUMENTS 2,982,547 A 5/1961 Carrier
5,154,671 A 10/1992 Smollar et al.
5,401,214 A 3/1995 Smollar et al.
5,548,851 A 8/1996 Wien et al.
5,551,922 A 9/1996 Katz et al.
5,669,822 A 9/1997 Smollar et al.
5,676,602 A 10/1997 Katz et al.
5,772,535 A * 6/1998 Murphy ..... A63B 5/11 273/349
6,062,983 A * 5/2000 Butsook ..... A63G 21/18 4/488

(Continued)

FOREIGN PATENT DOCUMENTS

CN 205513614 8/2016
WO WO 89/11316 11/1989

(Continued)

OTHER PUBLICATIONS

Extended European Search Report dated Jul. 12, 2017, in European Patent Application No. 16206621.1, 8 pages.

*Primary Examiner* — Kien Nguyen
(74) *Attorney, Agent, or Firm* — Squire Patton Boggs (US) LLP

(57) ABSTRACT

The present disclosure provides a children's entertainment device with a water slide, including: a water slide provided with a first chamber and a first valve; and a first water spray pipe connected with the water slide, the first water spray pipe being provided with a plurality of first water spray holes. Accordingly, the water slide, which may be filled with water, applied by the children's entertainment device with a water slide can reduce an impact force imposed to the ground by the user, so that the user can be well protected. The water-filled water slide can avoid direct contact between the user and the ground, so that the user can be protected from being cut by hard objects, such as stones, tree branches, so as to avoid accidental injuries. Further, a combination of water-filled water slide and a pool can provide more entertainments in comparison with existing water slides.

15 Claims, 7 Drawing Sheets

(56) References Cited

U.S. PATENT DOCUMENTS

| | | | | |
|---|---|---|---|---|
| 6,312,341 | B1 * | 11/2001 | Healy | A63G 21/18 472/116 |
| 6,406,377 | B1 * | 6/2002 | Demko | A63G 21/18 472/116 |
| D562,929 | S | 2/2008 | Fitzgerald | |
| 7,361,096 | B2 | 4/2008 | Sanchez | |
| 8,047,926 | B2 * | 11/2011 | Chen | A63G 31/12 472/134 |
| 9,446,323 | B2 | 9/2016 | Goldreyer | |
| 9,511,298 | B2 | 12/2016 | Sgromo et al. | |
| 2004/0077261 | A1 | 4/2004 | Fitzgerald | |
| 2008/0312003 | A1 | 12/2008 | Bogar | |
| 2010/0137068 | A1 | 6/2010 | Bogar et al. | |
| 2010/0285893 | A1 * | 11/2010 | Leimone | A63G 21/18 472/117 |
| 2016/0136528 | A1 | 5/2016 | Sgromo et al. | |

FOREIGN PATENT DOCUMENTS

| | | | |
|---|---|---|---|
| WO | WO 2009/137350 | A2 | 11/2009 |
| WO | WO 2009/137350 | A3 | 11/2009 |

* cited by examiner

CHILDREN'S ENTERTAINMENT DEVICE WITH WATER SLIDE

CROSS-REFERENCE TO RELATED APPLICATIONS

The present application claims priority to Chinese patent application No. 201621105309.8, filed on Oct. 8, 2016, and entitled "CHILDREN'S ENTERTAINMENT DEVICE WITH WATER SLIDE", and the entire disclosure of which is incorporated herein by reference.

TECHNICAL FIELD

The present disclosure generally relates to a children's entertainment device, and more particularly, to a children's entertainment device with a water slide.

BACKGROUND

In the field of children's entertainment devices, a water slide is a favorite lawn toy for children. Usually, the water slide includes: a slender plastic sheet fixed on ground, an inflatable bumper connected with the plastic sheet, and a water spray device for keeping the plastic sheet moist, so that a user can slide on the plastic sheet.

A specific using method of the water slide is: the user runs at first, and then throws himself/herself forward onto the plastic sheet, thereafter the user can slide forward due to an inertia generated during running.

In existing technologies, the plastic sheet applied in the water slide does not have a buffering component for reducing an impact force imposed to the ground by human body. Thus, when the user throws himself/herself onto the plastic sheet, the user may be hurt. In addition, in existing technologies, the plastic sheet of the water slide is mostly made of single-layer material, thus when the user slides on the plastic sheet in a high speed, hard objects, such as stones, tree branches, which are not cleared out of the ground or the grassland, may penetrate through the plastic sheet and cut the user's body.

SUMMARY

Existing water slides are not provided with a buffering component and it is easy for the user to be hurt. Accordingly, problem solved by the present disclosure includes: providing a children's entertainment device with a water slide to cure the recited deficiencies of the existing water slides.

In order to solve the above recited problem, the present disclosure provides a children's entertainment device with a water slide, including: a water slide, provided with a first chamber and a first valve; and a first water spray pipe connected with the water slide, the first water spray pipe being provided with a plurality of first water spray holes.

In some embodiments, the water slide includes an upper sheet and a lower sheet, an edge of the upper sheet and an edge of the lower sheet are connected to form the first chamber for containing water or air, and the upper sheet has a smooth surface for sliding.

In some embodiments, the water slide includes a plurality of ribbons, each of the plurality of ribbons has an upper edge connected with the upper sheet of the water slide and a lower edge connected with the lower sheet of the water slide.

In some embodiments, the children's entertainment device with a water slide further includes a bumper, wherein the bumper is provided with a second chamber, and the bumper is connected with the water slide.

In some embodiments, the bumper is connected with an edge of an end portion of the water slide.

In some embodiments, the bumper is connected with an upper sheet of the water slide.

In some embodiments, the second chamber of the bumper is used for containing water, and the bumper is provided with a plurality of second water spray hole.

In some embodiments, the second chamber of the bumper is used for containing air, and the bumper is provided with a second valve.

In some embodiments, the first water spray pipe is connected with a side edge of the water slide.

In some embodiments, the first water spray pipe is connected with an upper sheet of the water slide.

In some embodiments, the children's entertainment device with a water slide further includes a second water spray pipe, wherein the second water spray pipe is connected with an upper surface of the bumper, and the second water spray pipe is provided with a plurality of third water spray holes.

In some embodiments, a first connection pipe is configured between the first water spray pipe and the bumper, so that the first water spray pipe and the bumper communicate with each other.

In some embodiments, the first water spray pipe and the second water spray pipe are connected with each other.

In some embodiments, a second connection pipe is arranged between the first water spray pipe and the second water spray pipe, so that the first water spray pipe and the second water spray pipe communicate with each other.

In some embodiments, the water slide is rectangle-shaped and includes two opposite long sides and two opposite short sides.

In some embodiments, the bumper includes an arc-shaped structure and a first bottom sheet connected with the arc-shaped structure, and the first bottom sheet covers an inner side area of the arc-shaped structure.

In some embodiments, the bumper includes a closed-ring-shaped structure and a second bottom sheet connected with the closed-ring-shaped structure, and the second bottom sheet covers an inner side area of the closed-ring-shaped structure.

The children's entertainment device with a water slide provided by the present disclosure possesses at least the following advantages.

The water slide, which may be filled with water, applied by the children's entertainment device with a water slide can reduce an impact force imposed to the ground by the user, so that the user can be well protected. The water-filled water slide can avoid direct contact between the user and the ground, so that the user can be protected from being cut by hard objects, such as stones, tree branches, so as to avoid accidental injuries. Further, a combination of water-filled water slide and a pool can provide more pleasure in comparison with existing water slides.

BRIEF DESCRIPTION OF THE DRAWINGS

The above recited and other features, characters and advantages of the present disclosure will be more clear through descriptions of drawings and embodiments, in the drawings, a same label indicates a same feature, wherein.

DETAILED DESCRIPTION

Figure 1:
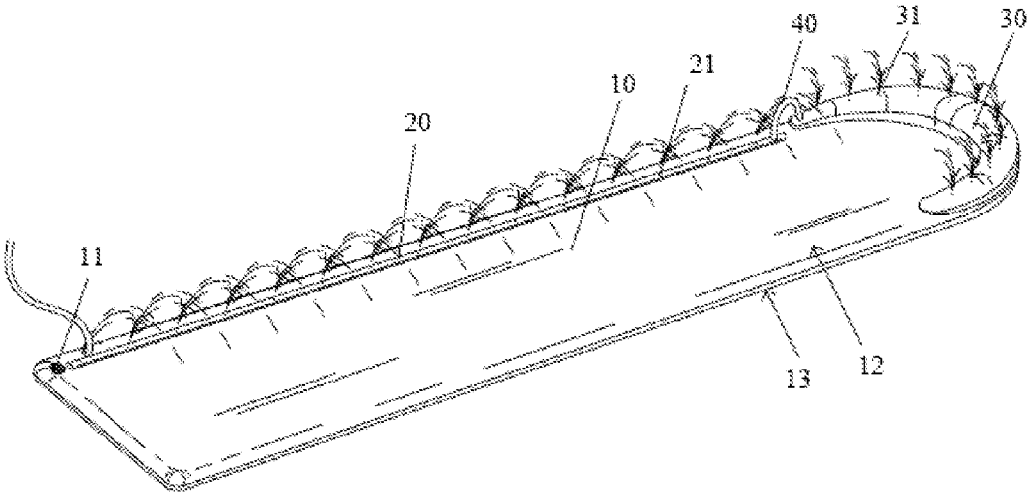
FIG. 1 schematically illustrates a first 3D diagram of a children's entertainment device with a water slide according to a first embodiment of the present disclosure.

In order to make above recited objectives, features and advantages of the present disclosure clear and easy to understand, embodiments of the present disclosure will be illustrated in detailed as follow in combination with corresponding drawings.

Embodiments of the present disclosure will be described in detail in conjunction with the accompanying drawings. The disclosure will be described with reference to certain embodiments which are exemplarily shown in the drawings. Under any possible circumstances, all the drawings will use a same label to represent a same or a similar part. In addition, even though terms used in the present disclosure are selected from terminologies publicly and commonly used, some of the terms mentioned in the detailed description of the present disclosure may be selected by the applicant according to his or her judgment, and meanings of these terms will be illustrated in corresponding parts of the description. Furthermore, the present disclosure should not be understood only through the terms used, but also through meanings of each term.

First Embodiment

Figure 2:
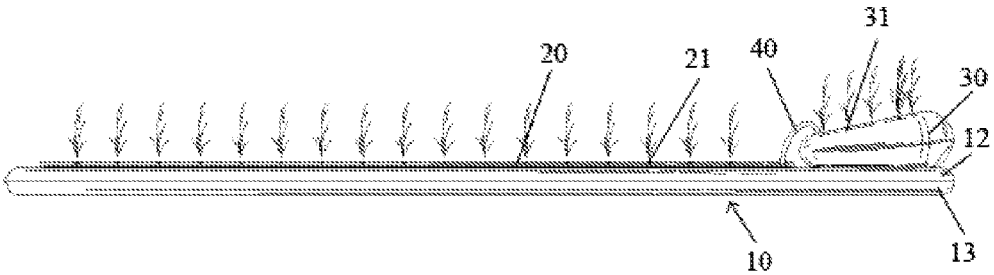
FIG. 2 schematically illustrates a first side view of the children's entertainment device with a water slide according to the first embodiment of the present disclosure.
Figure 3:
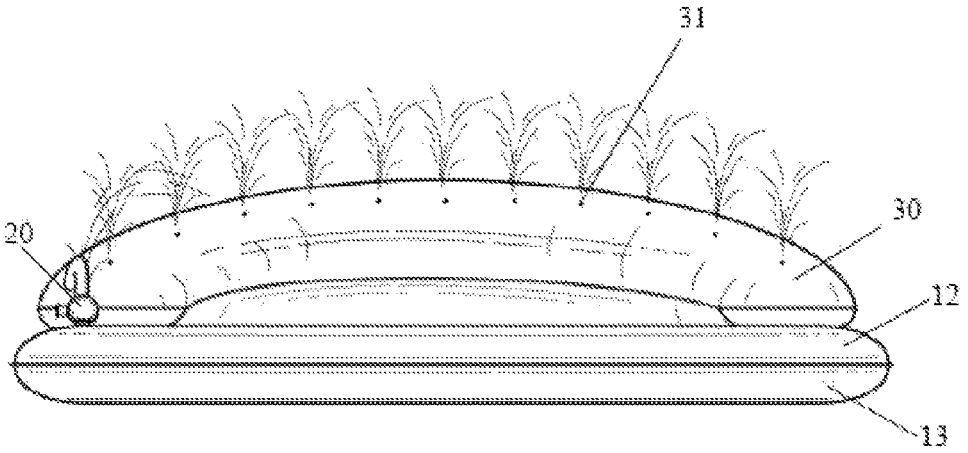
FIG. 3 schematically illustrates a first left view of the children's entertainment device with the water slide according to the first embodiment of the present disclosure.
Figure 4:
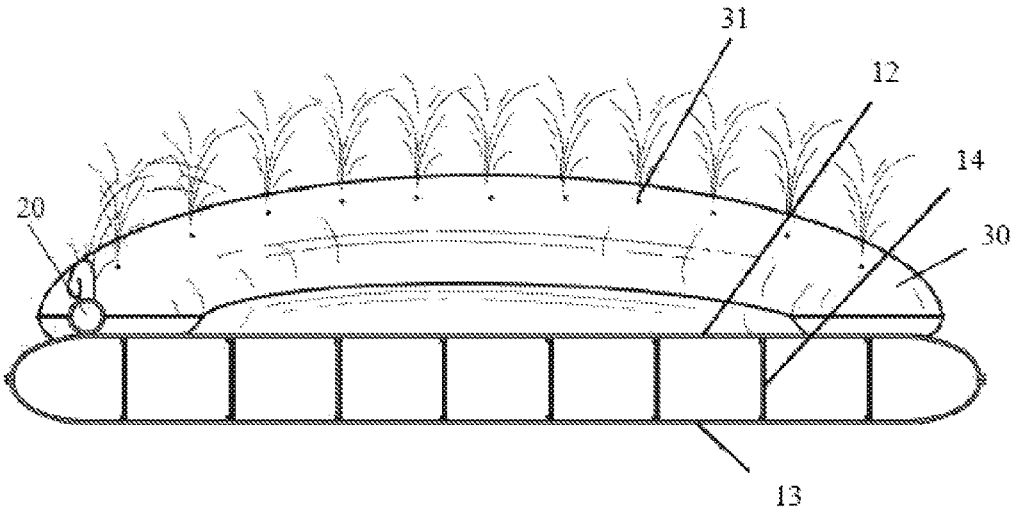
FIG. 4 schematically illustrates a first cross-sectional view of a children's entertainment device with a water slide of the present disclosure, along a longitudinal direction of the water slide.
Figure 5:
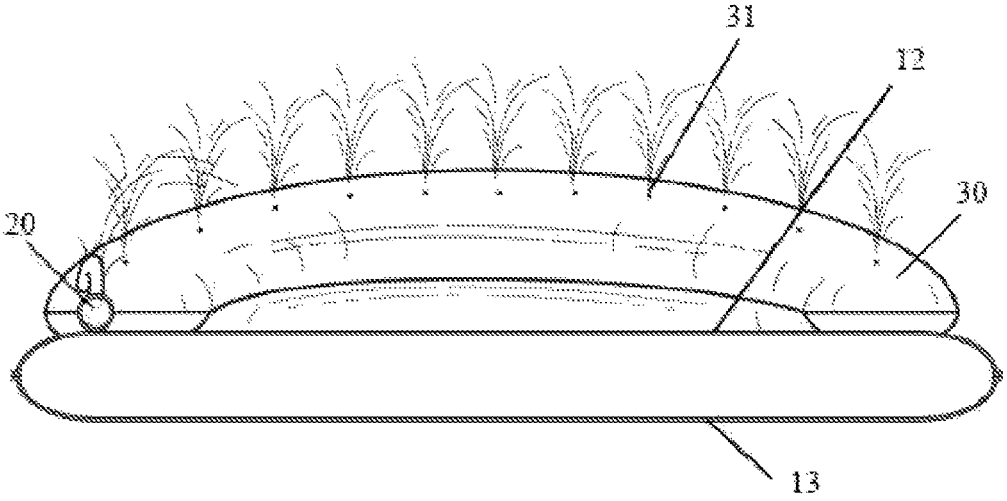
FIG. 5 schematically illustrates a second cross-sectional view of a children's entertainment device with a water slide of the present disclosure, along a longitudinal direction of the water slide.
Figure 6:
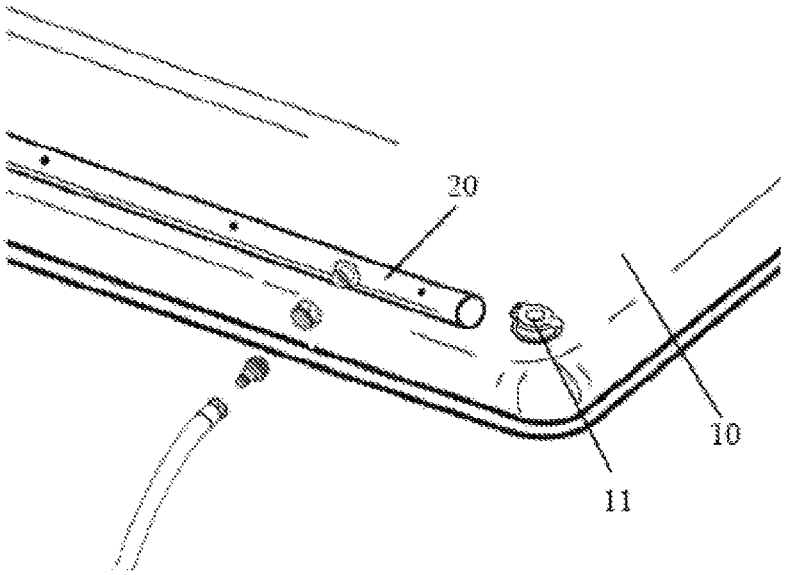
FIG. 6 schematically illustrates a first connection diagram of a first water spray pipe of the children's entertainment device with the water slide according to the first embodiment of the present disclosure.
Figure 7:
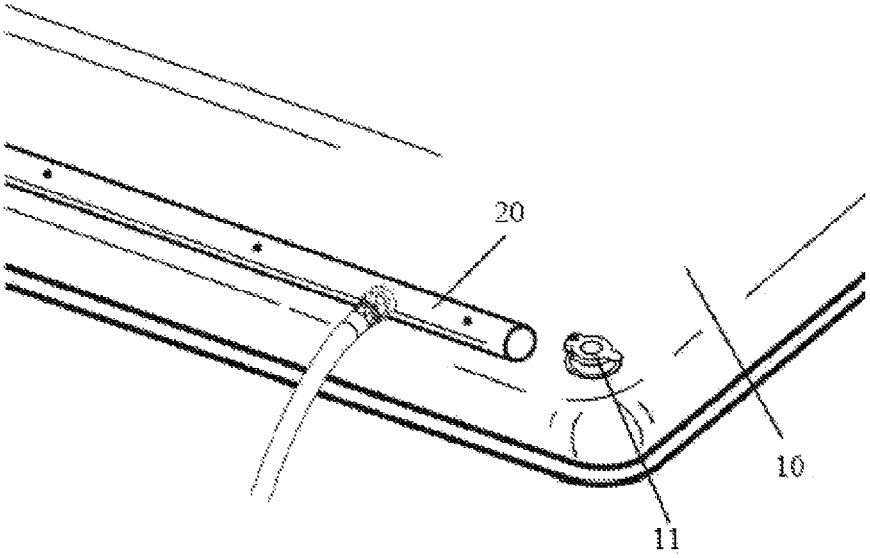
FIG. 7 schematically illustrates a second connection diagram of the first water spray pipe of the children's entertainment device with a water slide according to the first embodiment of the present disclosure.

FIG. 1 is a first 3D diagram of a children's entertainment device with a water slide according to a first embodiment of the present disclosure. FIG. 2 is a first side view of the children's entertainment device with a water slide according to the first embodiment of the present disclosure. FIG. 3 is a first left view of the children's entertainment device with the water slide according to the first embodiment of the present disclosure. FIG. 4 is a first cross-sectional view of a children's entertainment device with a water slide according to the present disclosure, along a longitudinal direction of the water slide. FIG. 5 is second first cross-sectional view of a children's entertainment device with a water slide of the present disclosure, along a longitudinal direction of the water slide. FIG. 6 is a first connection diagram of a first water spray pipe of the children's entertainment device with the water slide according to the first embodiment of the present disclosure. FIG. 7 is a second connection diagram of the first water spray pipe of the children's entertainment device with a water slide according to the first embodiment of the present disclosure.

As shown in FIGS. 1 to 7, the present disclosure provides a children's entertainment device with a water slide including a water slide 10 and a first water spray pipe 20. Wherein, the water slide is provided with a first chamber and a first valve 11, the first water spray pipe 20 is connected with the water slide 10, and the first water spray pipe 20 is provided with a plurality of first water spray holes 21.

In some embodiments, the water slide 10 is rectangle-shaped and includes two opposite long sides and two opposite short sides. In some embodiments, the water slide 10 includes an upper sheet 12 and a lower sheet 13. An edge of the upper sheet 12 and an edge of the lower sheet 13 are connected to form the first chamber, wherein the first chamber is used for containing water or air. The upper sheet 12 is provided with a smooth surface for sliding. In some embodiments, the first water spray pipe 20 is connected with the upper sheet 12 of the water slide 10.

Figure 8:
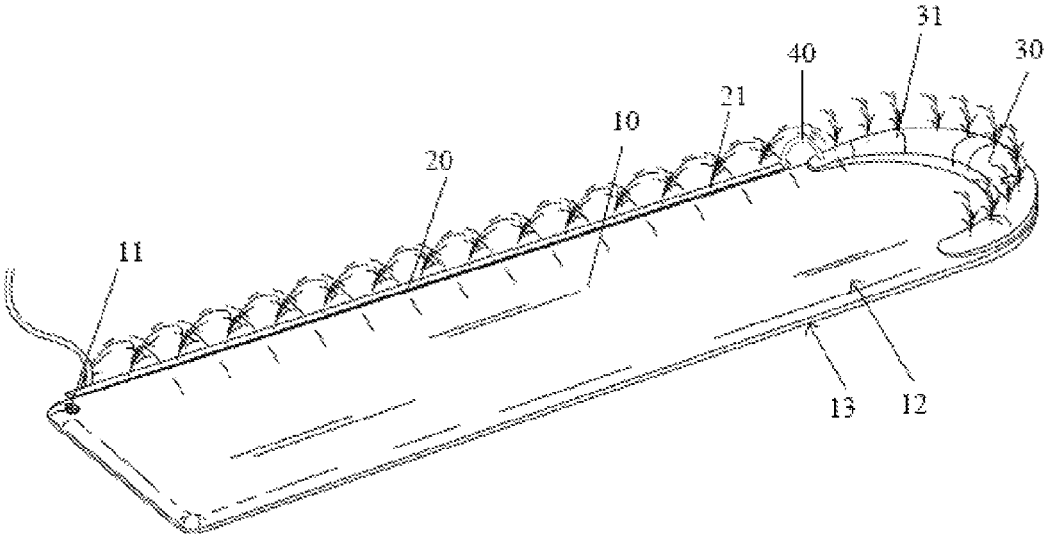
FIG. 8 schematically illustrates a second 3D diagram of the children's entertainment device with the water slide according to the first embodiment of the present disclosure.
Figure 9:
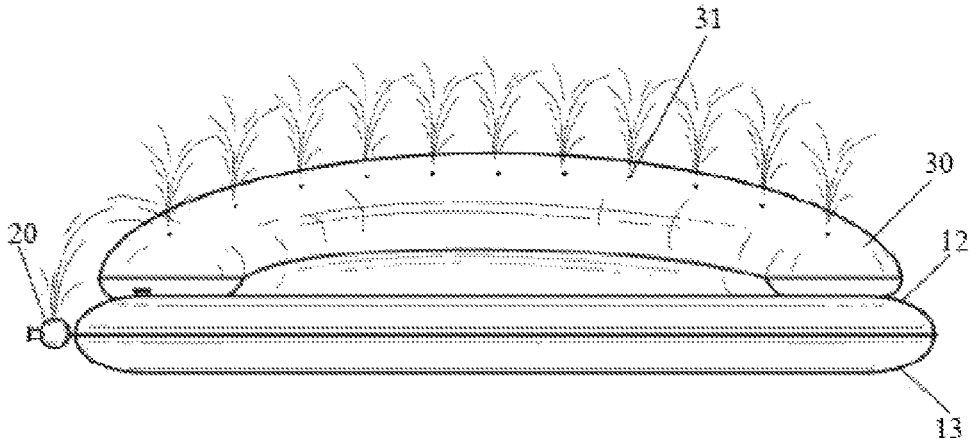
FIG. 9 schematically illustrates a second left view of the children's entertainment device with the water slide according to the first embodiment of the present disclosure.

FIG. 8 is a second 3D diagram of the children's entertainment device with the water slide according to the first embodiment of the present disclosure. FIG. 9 is a second left view of the children's entertainment device with the water slide according to the first embodiment of the present disclosure.

As shown in FIGS. 8 and 9, in some embodiments, the first water spray pipe 20 may be connected with a side edge of the water slide 10.

Further, as shown in FIG. 4, a plurality of ribbons 14 may be arranged inside the water slide 10, wherein an upper end of the ribbon 14 is connected with the upper sheet 12 of the water slide 10, and a lower end of the ribbon 14 is connected with the lower sheet 13 of the water slide 10. In practice, the ribbon 14 may be an I-shaped, V-shaped, Y-shaped, or X-shaped structure. As shown in FIG. 5, in some embodiments, there may be no ribbon arranged inside the water slide 10. In this case, the water slide 10 can be inflated with air or filled with water to an appropriate shape.

In some embodiments, the children's entertainment device with the water slide may further include a bumper 30. The bumper 30 is provided with a second chamber. The bumper 30 is connected with the water slide 10. For example, the bumper 30 may be connected with the upper sheet 12 of the water slide 10.

The second chamber of the bumper 30 is used for containing water, and the bumper 30 is provided with a plurality of second water spray holes 31. Or, the second chamber of the bumper 30 is used for containing air, and the bumper 30 is provided with a second valve for inflating air.

The first water spray pipe 20 and the bumper 30 are arranged with a first connection pipe 40 therebetween, so that the first water spray pipe 20 and the bumper 30 communicate with each other.

Figure 10:
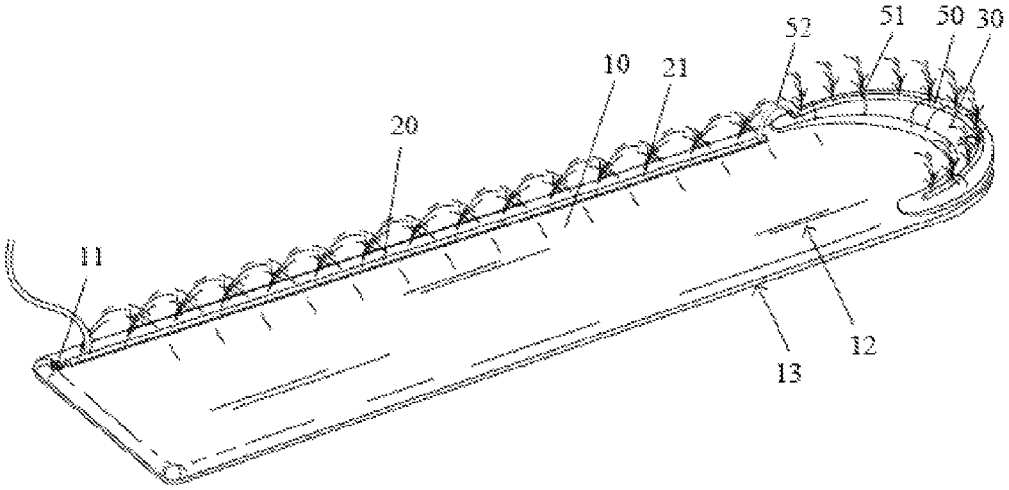
FIG. 10 schematically illustrates a third 3D diagram of the children's entertainment device with the water slide according to the first embodiment of the present disclosure.
Figure 11:
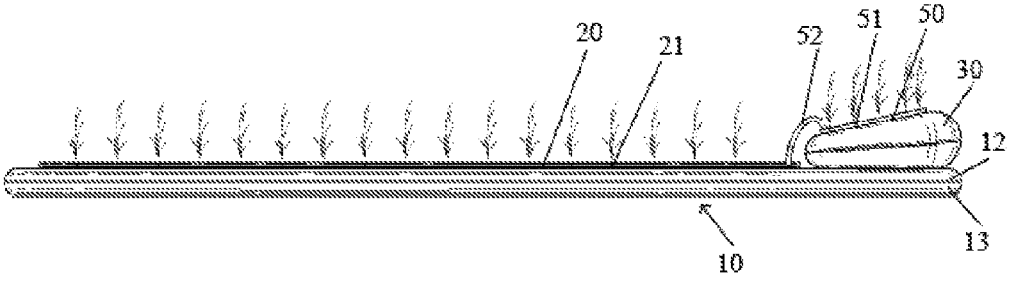
FIG. 11 schematically illustrates a second side view of the children's entertainment device with the water slide according to the first embodiment of the present disclosure.

FIG. 10 is a third 3D diagram of the children's entertainment device with the water slide according to the first embodiment of the present disclosure. FIG. 11 is a second side view of the children's entertainment device with the water slide according to the first embodiment of the present disclosure.

As shown in FIGS. 10 and 11, an upper surface of the bumper may be provided with a second water spray pipe 50, wherein the second water spray pipe 50 is provided with a plurality of third water spray hole 51. The first water spray pipe and the second water spray pipe are connected. For example, the first water spray pipe 20 and the second water spray pipe 50 are arranged with a second connection pipe 52 therebetween, so that the first water spray pipe 20 and the second water spray pipe 50 communicate with each other.

Second Embodiment

Figure 12:
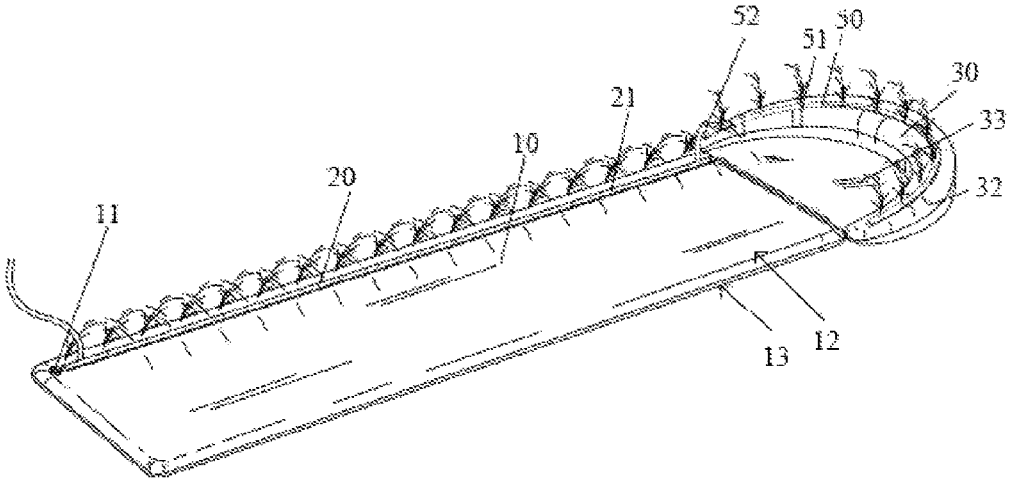
FIG. 12 schematically illustrates a 3D diagram of a children's entertainment device with a water slide according to a second embodiment of the present disclosure.
Figure 13:
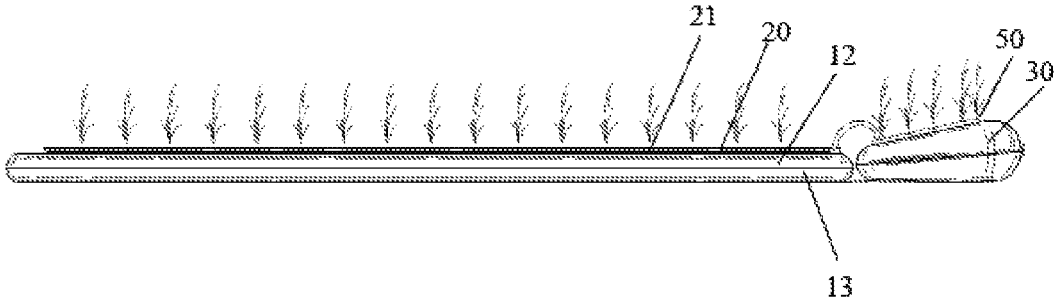
FIG. 13 schematically illustrates a side view of the children's entertainment device with the water slide according to the second embodiment of the present disclosure.

FIG. 12 is a 3D diagram of a children's entertainment device with a water slide according to a second embodiment of the present disclosure. FIG. 13 is a side view of the children's entertainment device with the water slide according to the second embodiment of the present disclosure.

As shown in FIGS. 12 and 13, the present disclosure provides another children's entertainment device with a water slide, including a water slide 10 and a first water spray pipe 20. Wherein, the water slide 10 is provided with a first chamber and a first valve 11, the first water spray pipe 20 and the water slide 10 are connected, and the first water spray pipe 20 is provided with a plurality of first water spray holes 21.

In some embodiments, the water slide 10 is rectangle-shaped and includes to opposite long sides and two opposite short sides. In some embodiments, the water slide 10 includes an upper sheet 12 and a lower sheet 13. An edge of the upper sheet 12 and an edge of the lower sheet 13 are connected to form the first chamber, wherein the first chamber is used for containing water or air. The upper sheet 12 is provided with a smooth surface for sliding. In some embodiments, the first water spray pipe 20 is connected with the upper sheet 12 of the water slide 10. In some embodiments, even not shown in FIGS. 12 and 13, the first water spray pipe 20 may be connected with a side edge of the water slide 10.

Further, the children's entertainment device with the water slide may include a bumper 30. The bumper 30 has a second chamber. The bumper 30 and the water slide 10 are connected. In the present embodiment, the bumper 30 is connected with an edge of an end portion of the water slide 10.

In particular, the bumper 30 of the present embodiment includes an arc-shaped structure 32 and a first bottom sheet 33. The first bottom sheet 33 and the arc-shaped structure 32 are connected, so that the first bottom sheet 33 covers an inner side area of the arc-shaped structure 32.

The second chamber of the bumper 30 may be used for containing water. Or, the second chamber of the bumper 30 may be used for containing air, and the bumper 30 be provided with a second valve for inflating air.

In the present embodiment, the children's entertainment device with a water slide further includes a second water spray pipe 50. The second water spray pipe 50 is connected with an upper surface of the bumper 30, and the second water spray pipe 50 is provided with a plurality of third water spray holes 51. The first water spray pipe and the second water spray pipe are connected. For example, the first water spray pipe 20 and the second water spray pipe 50 are arranged with a second connection pipe 52 therebetween, so that the first water spray pipe 20 and the second water spray pipe 50 communicate with each other.

Third Embodiment

Figure 14:
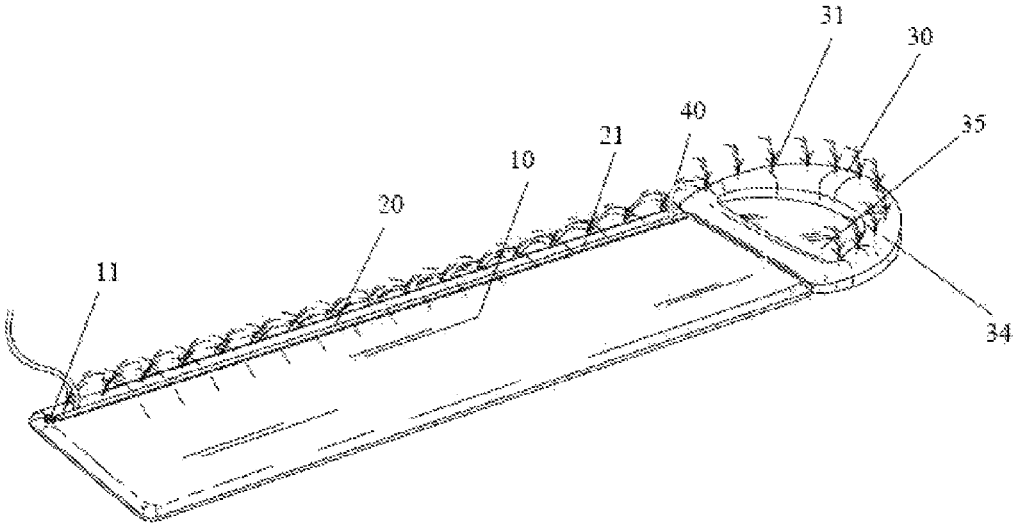
FIG. 14 schematically illustrates a 3D diagram of a children's entertainment device with a water slide according to a third embodiment of the present disclosure.

FIG. 14 is a 3D diagram of a children's entertainment device with a water slide according to a third embodiment of the present disclosure.

As shown in FIG. 14, the present disclosure provides a children's entertainment device with a water slide, including a water slide 10 and a first water spray pipe 20. Wherein, the water slide 10 is provided with a first chamber and a first valve 11, the first water spray pipe 20 and the water slide 10 are connected, and the first water spray pipe 20 is provided with a plurality of first water spray holes 21.

In some embodiments, the water slide 10 is rectangle-shaped and includes two opposite long sides and two opposite short sides. In some embodiments, the water slide 10 includes an upper sheet 12 and a lower sheet 13. An edge of the upper sheet 12 and an edge of the lower sheet 13 are connected to form the first chamber, wherein the first chamber is used for containing water or air. The upper sheet 12 is provided with a smooth surface for sliding. In some embodiments, the first water spray pipe 20 is connected with the upper sheet 12 of the water slide 10. In some embodiments, even not shown in FIG. 14, the first water spray pipe 20 may be connected with a side edge of the water slide 10.

Further, the children's entertainment device with the water slide may include a bumper 30. The bumper 30 has a second chamber. The bumper 30 and the water slide 10 are connected. In the present embodiment, the bumper 30 is connected with an edge of an end portion of the water slide 10.

In particular, the bumper 30 of the present embodiment includes a closed-ring-shaped structure 34 and a second bottom sheet 35. The second bottom sheet 35 and the closed-ring-shaped structure 34 are connected, so that the second bottom sheet 35 covers an inner side area of the closed-ring-shaped structure 34, and a structure similar to a pool is formed for retaining water.

The second chamber of the bumper 30 may be used for containing water, and the bumper 30 is provided with a plurality of second water spray holes 31. Or, the second chamber of the bumper 30 may be used for containing air, and the bumper 30 be provided with a second valve for inflating air.

The first water spray pipe 20 and a bumper 30 are arranged with a first connection pipe 40 therebetween, so that the first water spray pipe 20 and the bumper 30 communicate with each other. Of course, even not shown in FIG. 14, the bumper 30 may be provided with a second water spray pipe which has a structure similar to above recited embodiments.

According to above recited descriptions of the structures, in the present disclosure, a position of the first water spray pipe 20 and an arrangement of the second water spray pipe 50 in different embodiments may be configured to be the same, which can match with different bumpers 30 to realize similar effect.

In the present disclosure, structures and shapes of the water slide and the bumper, and number and positions of the water spray holes are not limited to that being described above and may varies according to practical needs. In addition, an illumination device, such as a LED strip, may be arranged inside or outside the water slide or the bumper. The water slide may be printed with patterns having a 3D effect thereon, so that the user can wear a pair of 3D glasses to have a special visual experience when sliding on the water slide.

From above, the water slide, which may be filled with water, applied by the children's entertainment device with a water slide can reduce an impact force imposed to the ground by the user, so that the user can be well protected. The water-filled water slide can avoid direct contact between the user and the ground, so that the user can be protected from being cut by hard objects, such as stones, tree branches, so as to avoid accidental injuries. Further, a combination of water-filled water slide and a pool can provide more entertainments in comparison with existing water slides.

Although the present disclosure has been disclosed above with reference to preferred embodiments thereof, it should be understood by those skilled in the art that various changes and modifications may be made without departing from the spirit or scope of the disclosure. Accordingly, the present disclosure covers changes and modifications made to the present disclosure that fall into scopes defined by the claims and equivalent technical solutions thereof.

The invention claimed is:

1. A children's entertainment device with a water slide, comprising:

a water slide provided with a first chamber and a first valve;

a first water spray pipe connected with the water slide, the first water spray pipe being provided with a plurality of first water spray holes;

wherein the water slide comprises an upper sheet and a lower sheet, an edge of the upper sheet and an edge of the lower sheet are directly connected to form the first chamber for containing water or air, the upper sheet has a smooth surface for sliding; and a plurality of ribbons, each of the plurality of ribbons has an upper edge connected with the upper sheet of the water slide and a lower edge connected with the lower sheet of the water slide.

2. The children's entertainment device with a water slide according to claim 1, further comprising a bumper, wherein the bumper is provided with a second chamber, and the bumper is connected with the water slide.

3. The children's entertainment device with a water slide according to claim 2, wherein the bumper is connected with an edge of an end portion of the water slide.

4. The children's entertainment device with a water slide according to claim 2, wherein the bumper is connected with an upper sheet of the water slide.

5. The children's entertainment device with a water slide according to claim 2, wherein the second chamber of the bumper is used for containing water, and the bumper is provided with a plurality of second water spray holes.

6. The children's entertainment device with a water slide according to claim 5, wherein a first connection pipe is arranged between the first water spray pipe and the bumper, so that the first water spray pipe and the bumper communicate with each other.

7. The children's entertainment device with a water slide according to claim 2, wherein the second chamber of the bumper is used for containing air, and the bumper is provided with a second valve.

8. The children's entertainment device with a water slide according to claim 2, further comprising a second water spray pipe, wherein the second water spray pipe is connected with an upper surface of the bumper, and the second water spray pipe is provided with a plurality of third water spray holes.

9. The children's entertainment device with a water slide according to claim 8, wherein the first water spray pipe and the second water spray pipe are connected with each other.

10. The children's entertainment device with a water slide according to claim 8, wherein a second connection pipe is arranged between the first water spray pipe and the second water spray pipe, so that the first water spray pipe and the second water spray pipe communicate with each other.

11. The children's entertainment device with a water slide according to claim 2, wherein the bumper comprises an arc-shaped structure and a first bottom sheet connected with the arc-shaped structure, and the first bottom sheet covers an inner side area of the arc-shaped structure.

12. The children's entertainment device with a water slide according to claim 2, wherein the bumper comprises a closed-ring-shaped structure and a second bottom sheet connected with the closed-ring-shaped structure, and the second bottom sheet covers an inner side area of the closed-ring-shaped structure.

13. The children's entertainment device with a water slide according to claim 1, wherein the first water spray pipe is connected with a side edge of the water slide.

14. The children's entertainment device with a water slide according to claim 1, wherein the first water spray pipe is connected with an upper sheet of the water slide.

15. The children's entertainment device with a water slide according to claim 1, wherein the water slide is rectangle-shaped and comprises two opposite long sides and two opposite short sides.

* * * * *